US007017554B2

(12) United States Patent
Wang

(10) Patent No.: US 7,017,554 B2
(45) Date of Patent: Mar. 28, 2006

(54) FUEL SUPPLY DEVICE OF AN INTERNAL COMBUSTION ENGINE

(75) Inventor: Xiumei Wang, Kariya (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 11/038,440

(22) Filed: Jan. 21, 2005

(65) Prior Publication Data

US 2005/0161024 A1 Jul. 28, 2005

(30) Foreign Application Priority Data

Jan. 22, 2004 (JP) ..... 2004-014377

(51) Int. Cl.
*F02M 37/04* (2006.01)

(52) U.S. Cl. ..... 123/446; 123/447; 123/198 DB

(58) Field of Classification Search ..... 123/198 F, 123/456, 500, 501, 506, 446, 179.17
See application file for complete search history.

(56) References Cited

U.S. PATENT DOCUMENTS 4,083,345 A * 4/1978 Davis ..... 123/366
4,597,369 A * 7/1986 Yasuhara ..... 123/458
4,777,921 A * 10/1988 Miyaki et al. ..... 123/456
5,058,553 A * 10/1991 Kondo et al. ..... 123/456
5,197,438 A * 3/1993 Kumano et al. ..... 123/506
5,201,294 A 4/1993 Osuka
5,277,156 A * 1/1994 Osuka et al. ..... 123/198 DB
5,678,521 A * 10/1997 Thompson et al. ..... 123/447
5,771,864 A * 6/1998 Morishita et al. ..... 123/456
5,983,863 A * 11/1999 Cavanagh et al. ..... 123/447
6,095,118 A * 8/2000 Klinger et al. ..... 123/446
6,694,950 B1 * 2/2004 Djordjevic ..... 123/446

FOREIGN PATENT DOCUMENTS

JP 2000-18052 8/1997
JP 9-222056 1/2000

* cited by examiner

*Primary Examiner*—Carl S. Miller
(74) *Attorney, Agent, or Firm*—Nixon & Vanderhye PC

(57) ABSTRACT

A fuel supply device includes a fuel pump, a plurality of valves, and a controller. The fuel pump includes a plurality of pressure chambers each having a volume that is expanded and contracted by the engine. The plurality of valves open and close the pressure chambers. An expansion time and a contraction time of the pressure chambers are each different. The fuel pump is operable to sealingly store fuel in the pressure chambers by closing the valves. The controller sets closing times for the valves in accordance with a required quantity of fuel to be force fed. The controller switches between a normal control in which all of the pressure chambers sequentially force feed fuel and a thinned-out control in which the force fed fuel is thinned out by stopping closing at least one of the valves.

15 Claims, 5 Drawing Sheets

FUEL SUPPLY DEVICE OF AN INTERNAL COMBUSTION ENGINE

CROSS REFERENCE TO RELATED APPLICATIONS

This application is based upon and claims the benefit of priority of Japanese Patent Application No. 2004-14377, filed on Jan. 22, 2004, the contents of which are incorporated herein by reference.

FIELD OF THE INVENTION

The present invention relates to a fuel supply device of an internal combustion engine.

BACKGROUND OF THE INVENTION

A typical fuel supply device of an internal combustion engine mounted in a vehicle includes a fuel pump. In the fuel supply device, fuel is pressurized and a mist is sprayed via an injector. In recent years, a common-rail type internal combustion engine having a common rail for storing fuel to be supplied to the injector that has been pressurized in advance is widely known. In this type of internal combustion engine, the fuel is forced from the fuel pump to the common rail. Such fuel supply devices are disclosed Laid-Open Japanese Patent Application Publication No. 9-222056 and Laid-Open Japanese Patent Application Publication No. 2000-18052.

The fuel pump includes a pressure chamber. The volume of the pressure chamber is expanded and contracted by the power of the engine. Fuel having a relatively low pressure is introduced into the pressure chamber. The fuel is discharged during a contraction process in which the volume of the pressure chamber is contracted. The fuel is sealingly stored in the pressure chamber by closing an opening/closing valve at a predetermined time. Then, with the contraction of the volume of the pressure chamber, the fuel in the pressure chamber is forced out. Usually, a plurality of pressure chambers is provided, each of which is expanded and contracted at different times from other pressure chambers. A control unit controls the opening/closing valve so that the closing time is set in accordance with the fed quantity of fuel that is required. Putting the closing time ahead so as to seal the fuel in the pressure chamber when the volume of the pressure chamber is large increases the fed quantity of fuel. On the other hand, delaying the closing time so as to seal the fuel in the pressure chamber when the volume of the pressure chamber is small reduces the fed quantity of fuel. For example, in the aforementioned common-rail type, the pressure of the fuel in the common rail is detected and then the fed quantity of fuel that is required is set in such a manner that the detected pressure is a target pressure.

A cam that operates by the power of the engine achieves expansion and contraction of the volume of the pressure chamber. The contraction rate of the volume of the pressure chamber depends on the shape of the cam. In general, the contraction rate has a peak in the latter half of the contraction process in which the volume of the pressure chamber is contracted.

SUMMARY OF THE INVENTION

In the aforementioned common-rail type internal combustion engine, improvement of the precision of the force fed fuel, reduction of the driving torque of the fuel pump as a load on the output of the internal combustion engine, and reduction of energy consumption are demanded. In order to achieve these, improvement of the structure of the fuel supply device has been made earnestly.

The present invention was made in view of the circumstances described above. It is an object of the present invention to provide a fuel supply device of an internal combustion engine that can easily reduce a driving torque and energy consumption by devising a control over the fuel supply device, not by improving the structure of the fuel supply device itself.

According to one aspect of the present invention, a fuel supply device of an internal combustion engine comprises: a fuel pump including a plurality of pressure chambers each having a volume that is expanded and contracted by a power of the engine and a plurality of opening/closing valves, provided to correspond to the plurality of pressure chambers in one-to-one correspondence, for opening and closing the pressure chambers, respectively, an expansion time and a contraction time of the pressure chamber being different from those of another pressure chamber, the fuel pump being operable to seal fuel stored in the pressure chambers by closing the opening/closing valves and supply the fuel in the pressure chambers with contraction of the volumes of the pressure chambers; and a controller for setting closing times of the opening/closing valves in accordance with required quantity of the fuel to be force fed.

The controller is operable to switch control of the opening/closing valves between a normal control in which all of the plurality of pressure chambers force the fuel sequentially and a thinned-out control in which forcing the fuel is thinned out by stopping closing of a part of the opening/closing valves out of the plurality of opening/closing valves to place the fuel in the pressure chamber in a non-pressurized state.

In a contraction process in which the volume of the pressure chamber of the fuel pump is contracted, the contraction rate has a peak in the latter half of the contraction process. At this peak, the driving torque is also larger. In the thinned-out control, for a part of the pressure chambers, the force fed fuel is thinned out. The pressure chamber for which the force fed fuel is not thinned out is burdened with the thus thinned out feed. With the increase of the burden, in the pressure chamber for which the force fed fuel is not thinned out, the closing time of the opening/closing valve is put ahead. Thus, part of the force fed fuel can be preformed in a period in which the driving torque is relatively smaller, not in a period in which the driving torque is larger. On the other hand, in the pressure chamber for which the force fed fuel is thinned out, the driving torque is substantially zero. Therefore, the driving torque of the fuel supply device can be reduced.

Moreover, it is also possible to reduce the operation frequency of the opening/closing valve. Therefore, the energy consumption of the fuel supply device can be reduced, and the life thereof can be made longer.

According to another aspect of the present invention, the configuration described above is set to perform a transition control in which the closing time of the opening/closing valve of the pressure chamber for which the forcing of fuel has been thinned out is initially delayed to forcedly feed small quantity of the fuel and is then gradually put ahead to increase the forced feed quantity of the fuel, immediately after switching from the thinned-out control to the normal control.

It is possible to smoothly perform the switching from the normal control to the thinned-out control.

According to another aspect of the present invention, the configuration described above is set to perform another transition control in which the closing time of the opening/closing valve of the pressure chamber for which the forced feed of the fuel is to be thinned out is gradually delayed to gradually reduce the forced feed amount of the fuel, immediately before switching from the normal control to the thinned-out control.

It is possible to smoothly perform the switch from the thinned-out control to the normal control.

According to another aspect of the present invention, the controller is set to determine a degree of a request of the forcing of the fuel at the present time and immediately after the present time based on an operating state of the internal combustion engine and to select the thinned-out control in an operating state in which the degree of the request of the forced feed of the fuel is weak.

If the request for the force fed fuel is weak at the present time and immediately after the present time, a shortage of the force fed fuel does not occur even when the thinned-out control is performed. Thus, the thinned-out control can be performed in an appropriate operating state.

Other features and advantages of the present invention will be appreciated, as well as methods of operation and the function of the related parts from a study of the following detailed description, appended claims, and drawings, all of which form a part of this application. In the drawings:

DETAILED DESCRIPTION OF THE PREFERRED EMBODIMENTS

Figure 1:
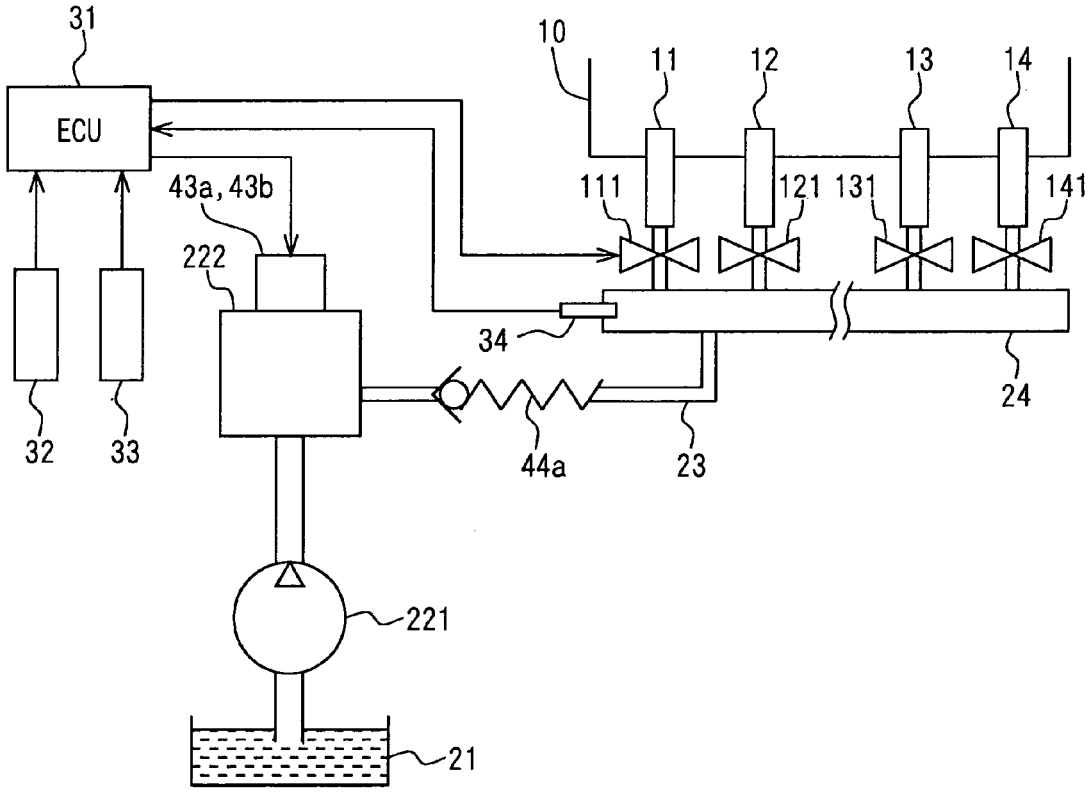
FIG. 1 is a schematic diagram of a fuel supply device of the present invention applied to a diesel engine.

FIG. 1 shows the structure of a diesel engine (hereinafter, simply referred to as engine) as a contraction-ignition type internal combustion engine to which a fuel supply device of the present invention is applied. This embodiment is described on the assumption that the engine is mounted on a vehicle. An engine body 10 includes a plurality of cylinders. Injectors 11, 12, 13, and 14 are provided to correspond to the cylinders of the engine body 10 in one-to-one correspondence. Each of the injectors 11, 12, 13, and 14 is opened and sprays fuel at a predetermined time for a predetermined period by control of an ECU 31. The injectors 11, 12, 13, and 14 are opened by electromagnetic valves 111, 121, 131, and 141 provided for the injectors 11, 12, 13, and 14, respectively. Fuel is injected during a period approximately corresponding to the period in which each electromagnetic valve is driven. The engine body 10 has a typical structure and also includes a component that is not shown, such as an inlet and exhaust valve provided for each cylinder.

Fuel supply to the injectors 11–14 is provided by a common rail 24. To the common rail 24, a fuel pump 22 is connected via a high-pressure fuel supply tube 23. Thus, low-pressure fuel pumped from a fuel tank 21 is force fed to the common rail 24. The fuel pressure in the common rail 24 (hereinafter, referred to as common-rail pressure, if necessary) determines the injection pressure of the injectors 11–14.

The fuel pump 22 includes a feed pump part 221 that pumps fuel from the fuel tank 21 and a fuel feed part 222 that force feeds the fuel to the common rail 24. The structure of the fuel feed part 222 is described with reference to FIGS. 2 and 3. The fuel feed part 222 includes two pumps 4*a* and 4*b* (hereinafter, the pump 4*a* is called as the first pump 4*a*, and the pump 4*b* is called as the second pump 4*b*). The first pump 4*a* and the second pump 4*b* have substantially the same structure. For the structure of the pumps 4*a* and 4*b*, description is made with reference mainly to FIG. 3, which shows a cross-section of the first pump 4*a*. In each pump 4*a*, 4*b*, a plunger 42*a* is held in a cylinder 41*a* to be freely slidable therein. The cylinder 41*a* is arranged in such a manner that the length direction thereof is coincident with a vertical direction. The space defined by a bore face of the cylinder 41*a* and an upper end face of the plunger 42*a* forms a pressure chamber 402*a*. On the lower end of the plunger 42*a*, a sliding element 54*a* and a cam roller 53*a* are provided.

The cylinder 41*a* of the pump 4*a*, 4*b* is horizontally arranged. A pump rotation shaft 51 is provided below the cylinder 41*a* and extends along the arranged direction of the cylinder 41*a*. The pump rotation shaft 51 is integrated with a cam 52*a* for vertically reciprocating the plunger 42*a*. The plunger 42*a* is vertically reciprocated by the power of the engine that is transmitted to the pump rotation shaft 51 at a predetermined reduction ratio, thereby expanding and contracting the volume of the pressure chamber 402*a*. The cam 52*a* has three cam lobes at intervals of 120 degrees on the pump rotation shaft 51. Rotation of the pump rotation shaft 51 by 120 degrees corresponds to one period of vertical reciprocation of the plunger 42*a*. Moreover, a phase difference corresponding to the rotation of the pump rotation shaft 51 by 60 degrees is set between the cam 52*a* for the first pump 4*a* and a cam (not shown) for the second pump 4*b*. Thus, the plunger 42*a* of the first pump 4*a* and the plunger 42*b* of the second pump 4*b* alternately vertically reciprocate. It should be noted that the pump rotation shaft 51 transmits the power for driving the feed pump 221, in addition to the power for the fuel feed part 222.

Figure 2:
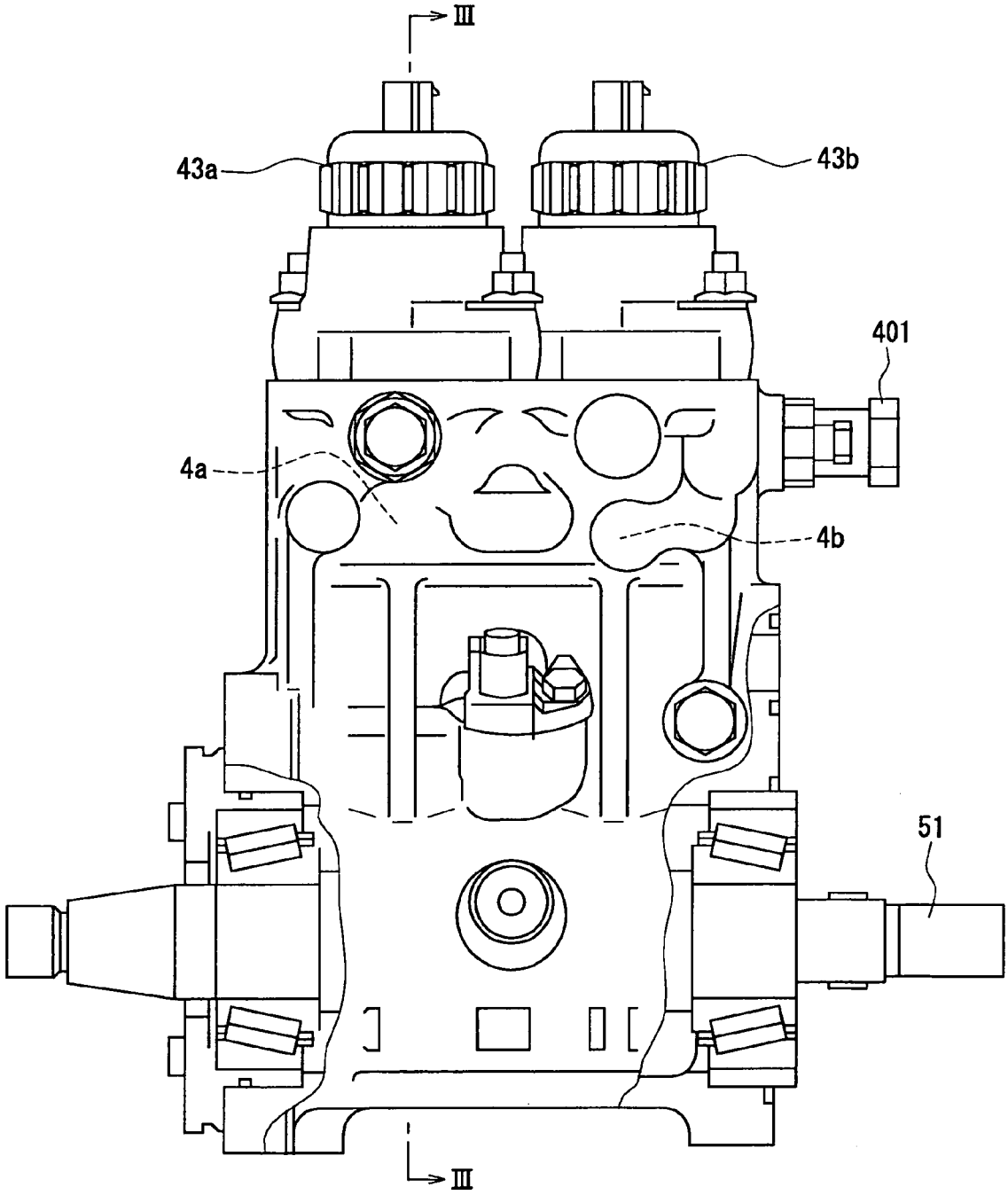
FIG. 2 is a side view of a fuel pump of the fuel supply device of FIG. 1.
Figure 3:
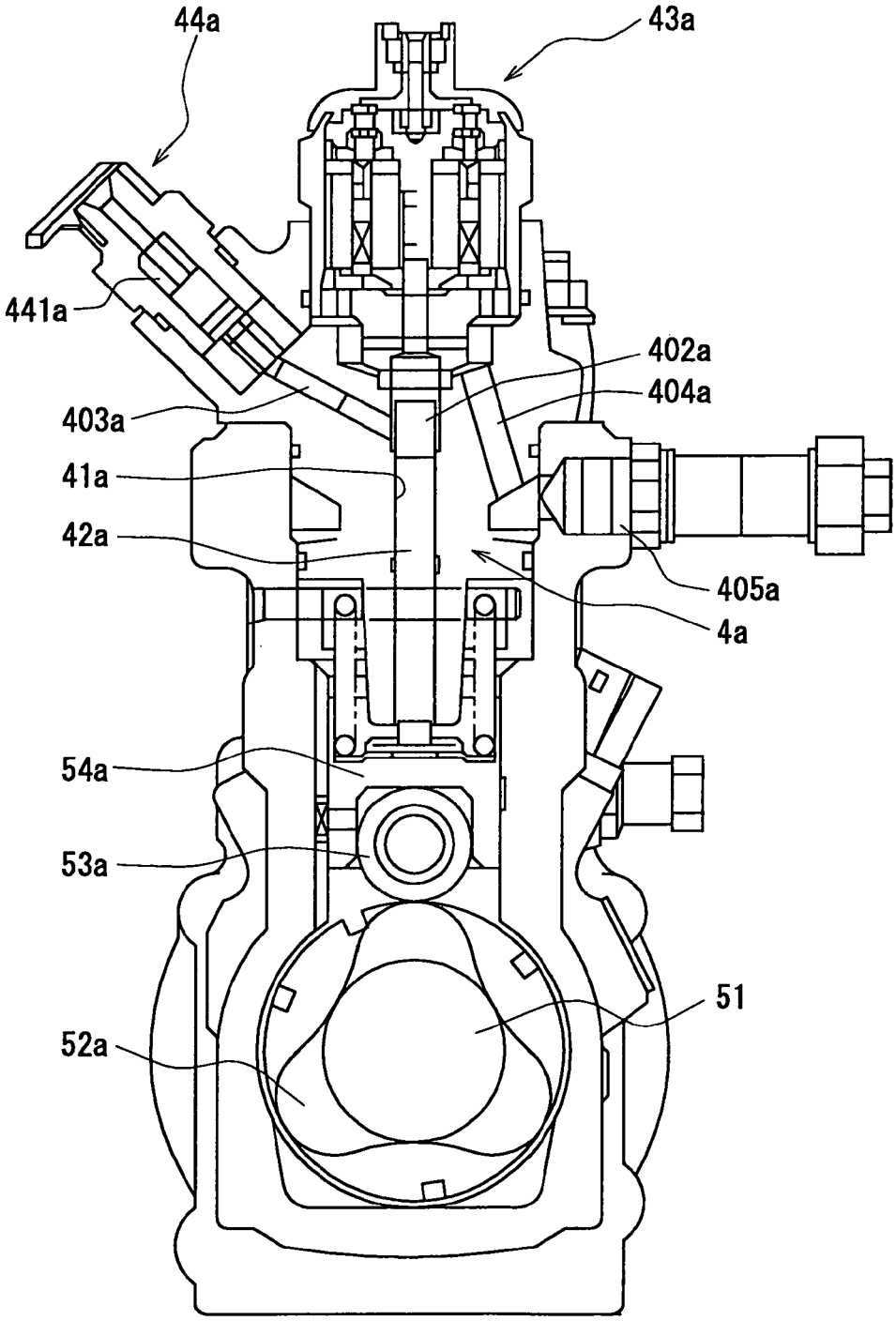
FIG. 3 is a cross-sectional view of the fuel pump of FIG. 2 taken along the line III—III of FIG. 2.

The fuel pumped by the feed pump 221 flows through an external filter (not shown) and is introduced into the pressure chamber 402*a* via an entrance 401 (shown in FIG. 2).

At an upper end of the cylinder 41*a* of the first pump 4*a*, a PCV 43*a* that serves as an opening/closing valve is provided to face the pressure chamber 402*a*. It should be appreciated that a second PCV 43*b* is also provided atop the second pump 4*b*, as shown in FIG. 2. While the PCV 43*a* is opened, the pressure chamber 402*a* is in communication with the fuel tank 21. The fuel in the pressure chamber 402*a* is discharged to a return path 404*a* and is then returned to the fuel tank 21 via a return outlet 405*a*. This occurs with upward movement of the plunger 42*a* caused by lifting of the cam lobe of the cam 52*a*. On the other hand, while the PCV 43*a* is closed, the fuel is sealingly stored within the pressure chamber 402*a*. The fuel that is sealed in the pressure chamber 402*a* while the PCV 43*a* is closed is fuel that is to be force fed. The fuel pressurized by the plunger 42*a* flows from a discharge channel 403*a* to a check valve 44*a*. The check valve 44*a* is a non-return valve that communicates with the high-pressure fuel supply tube 23 at its outlet. In the check valve 44*a*, a direction from the pressure chamber 402*a* toward the common rail 24 is set to the forward direction. The check valve 44*a* includes a spring 441*a* for defining a discharge pressure.

The PCVs 43*a* and 43*b* are electromagnetic valves that are opened and closed by control of the ECU 31.

A period in which fuel is force fed is a period from the closing of the PCV 43*a* until when the plunger 42*a* reaches the top dead center. As the closing time of the PCV 43*a* moves ahead, the period of force feeding the fuel becomes longer. On the other hand, as the closing time of the PCV 43*a*, 43*b* is delayed, that period becomes shorter. The characteristics of the change of the driving torque in the longest period of the force fed fuel, which is achieved by setting the closing time of the PCV 43*a*, 43*b* to the earliest time, depends on the upward moving rate of the plunger 42*a* defined by the shape of the cam lobe of the cam 52*a*. The upward moving rate of the plunger 42*a* defined by the shape of the cam lobe has a peak near the top dead center of the plunger 42*a*. The aforementioned change of the driving torque has characteristics in which the change is small at the early stage of the period in which the cam lobe of the cam 52*a* is lifted (hereinafter, simply referred to as cam lifting period, if necessary) and increases near the end of the cam lifting period. Thus, in the case where the closing time is late and the feed quantity of fuel is small, the force fed fuel is carried out in a period in which the driving torque is relatively larger.

The ECU 31 controls respective parts of the engine, such as the injectors 11–14, based on an operating state of the engine that is determined from sensors provided in the respective parts of the engine. As such sensors, a rotation speed sensor 32 for detecting a speed of rotation of the engine (hereinafter, referred to as engine rotation speed, if necessary) and a throttle position sensor 33 for detecting an opening degree of an intake throttle valve (hereinafter, referred to as throttle opening degree) are provided. Moreover, a pressure sensor 34 for detecting the common-rail pressure is attached to the aforementioned common rail 24. Other than the shown sensors, sensors attached to a typical engine are also provided.

The ECU 31 is formed mainly by a microcomputer. The ECU 31 calculates a target injection quantity based on the operating state including the throttle opening degree and sets the aforementioned energization period that defines the opening period of the injectors 11–14. Please note that the present engine can be controlled by an auto-cruise control and when a driver has selected the auto-cruise mode, the target injection quantity is set to make the speed of the vehicle the same as the set speed. Moreover, the ECU 31 calculates the quantity of the fuel to be force fed for making the pressure detected by the pressure sensor 34 the same as a target pressure and controls the PCVs 43*a* and 43*b* of the fuel pump 22 while regarding the calculated feed quantity as required feed quantity. The target pressure is calculated based on the operating state that is known from the aforementioned sensors.

Figure 4:
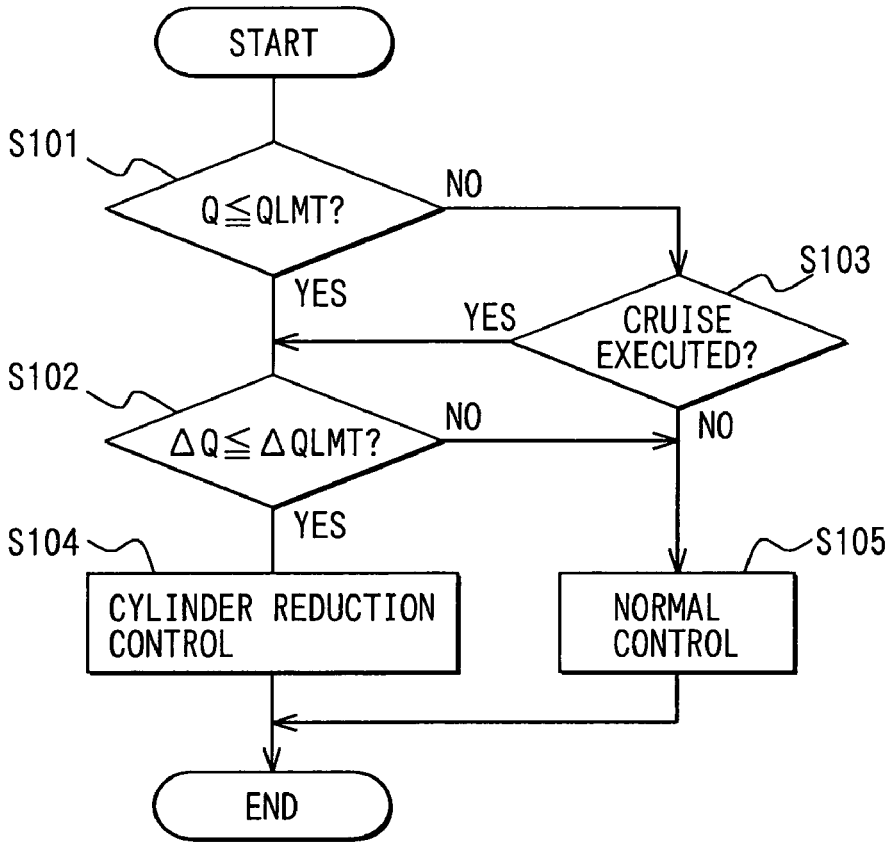
FIG. 4 is a flowchart of a control process performed by an ECU of the fuel supply device of FIG. 1.

FIG. 4 is a flowchart of a control over the PCVs 43*a* and 43*b*. This routine is run for every predetermined crank angle. In Step S101, it is determined whether or not the injection quantity Q of fuel is equal to or smaller than a reference value QLMT. The injection quantity Q is an injection quantity per one stroke of the cylinder of the engine body 10 and can be calculated based on a value of an injection-quantity instruction. If the answer to Step S101 is yes, it is then determined in Step S102 whether or not the change amount ΔQ of the injection quantity Q (hereinafter, referred to as injection-quantity change amount) is equal to or smaller than a reference value ΔQLMT. Please note that the injection-quantity change amount ΔQ is a difference between the previous injection quantity Q and the current injection quantity Q.

If the answer in Step S102 is yes, then a cylinder reduction control serving as a thinned-out control is selected in Step S104. If the answer in Step S102 is no however, a normal control is selected in Step S105. Details of the cylinder reduction control and the normal control are described later.

On the other hand, if the answer in Step S101 above is no, it is then determined in Step S103 whether or not the auto-cruise control is operating. If yes in Step S103, the routine goes to Step S102 as described before. If no in Step S103, the routine goes to Step S105 as described before.

Figure 5A:
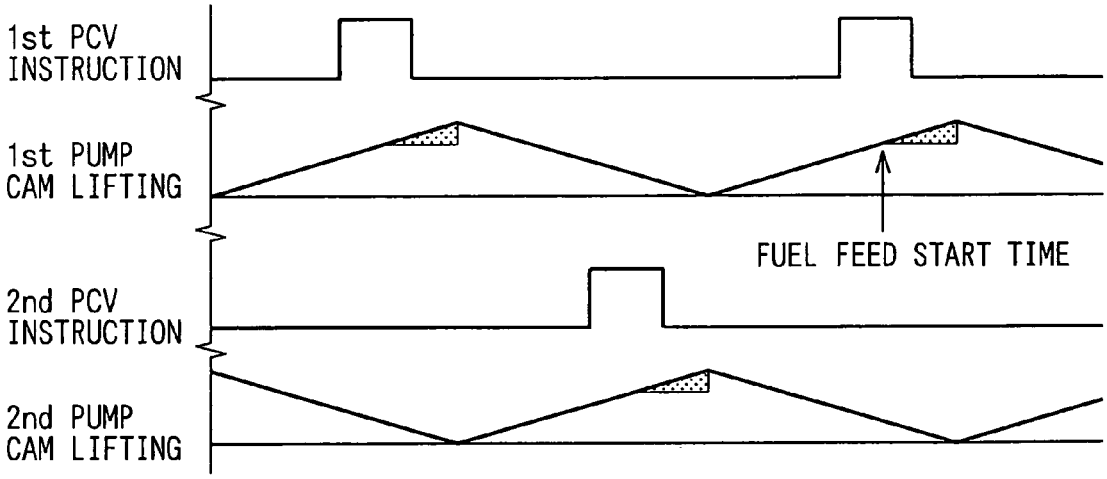
FIG. 5A is a timing chart of a normal control operation of the fuel supply device of FIG. 1.
Figure 5B:
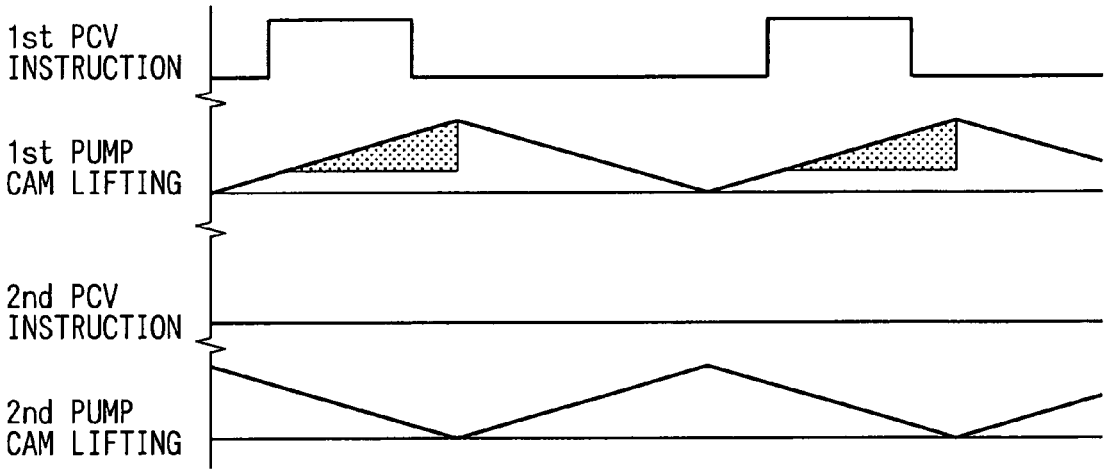
FIG. 5B is a timing chart of a reduction control operation of the fuel supply device of FIG. 1.

The normal control and the cylinder reduction control are described. FIGS. 5A and 5B show energization instructions to the PCVs 43*a* and 43*b* and lifting of the cams of the pumps 4*a* and 4*b*. In FIGS. 5A and 5B, shaded regions in the cam lifting chart present periods in which fuel is force fed. FIG. 5A corresponds to the normal control and FIG. 5B corresponds to the cylinder reduction control. The lifting of the cam in the first pump 4*a* and that in the second pump 4*b* occur in reversed phase, as described before. Thus, the pressure chambers 42*a* of the pumps 4*a* and 4*b* are alternately expanded and contracted. In the normal control, in both the pumps 4*a* and 4*b*, the PCVs 43*a* and 43*b* are closed at any times during the periods in which the cams are lifted, thereby fuel is force fed. It should be noted that energizing the PCVs 43*a*, 43*b* terminates in the middle of the fuel-feed period, as shown in FIG. 5A. This is because the PCVs 43*a*, 43*b* are outwardly-opening valves that are lifted toward the inside of the pressure chamber 402*a* and kept closed while the fuel pressure in the pressure chamber 402*a* is larger than a predetermined value.

On the other hand, in the cylinder reduction control of FIG. 5B, the energization to the second PCV 43*b* is not performed in the shown example. Thus, the force fed fuel is performed only by the first pump 4*a*. In accordance with this, the feed quantity by the first pump 4*a* increases. For example, if the feed quantity that is required is the same as that in the normal control, the feed quantity by the first pump 4*a* in the cylinder reduction control is basically twice, and the closing time of the PCV 43*a* occurs earlier.

As described before, the driving torque at the beginning of the cam lifting period is smaller than that at the end. In the cylinder reduction control, the force fed fuel is carried out at the early stage of the cam lifting period in which the driving torque is small, not near the end of the cam lifting period in which the driving torque is large. Thus, the driving torque can be reduced. Moreover, since energizing the second PCV 43*b* is not performed, energy consumption is reduced. In the present embodiment, by switching the normal control to the cylinder reduction control in an appropriate manner based on the operating state by executing Steps S101 to S103, the driving torque can be reduced and energy consumption can be suppressed.

As is apparent from FIGS. 5A and 5B, the cylinder reduction control is selected in the case where the injection quantity Q is equal to or smaller than its reference value QLMT and the injection-quantity change amount ΔQ is equal to or smaller than its reference value ΔQLMT. This case corresponds to the operating state in which it is not necessary to use both the pumps 4*a* and 4*b* for the fuel feed and which can be regarded as a state in which a request for force fed fuel does not become strong rapidly because of sudden speed-up, i.e., the operating state in which the fuel feed request is weak at present and immediately after of the present time. In such an operating state, selection of the cylinder reduction control provides a large advantage. The reference value QLMT is preferably set to an appropriate value for distinguishing an idling state and other states, for example. This is because in the idling state the request of forcedly feeding the fuel is not strong and is constant.

Even in the case where the injection quantity Q is equal to or larger than the reference value QLMT, when the auto-cruise control is in execution, the cylinder reduction control is selected under condition where the injection-quantity change amount ΔQ is not larger than its reference value ΔQLMT. In the auto-cruise control, the fuel feed request is relatively weak and the selection of the cylinder reduction control provides a large advantage, except for a case where the injection quantity of fuel increases because of resistance the vehicle receives on a sloped road or the like and, therefore, the fuel feed request is expected to increase.

In the operating state other than the aforementioned operating states, it is desirable that the force fed fuel be shared by two pumps 4*a* and 4*b* so as not to apply a load of fuel feeding on either of the pumps 4*a* and 4*b* more heavily. Thus, the normal control is selected.

Figure 6:
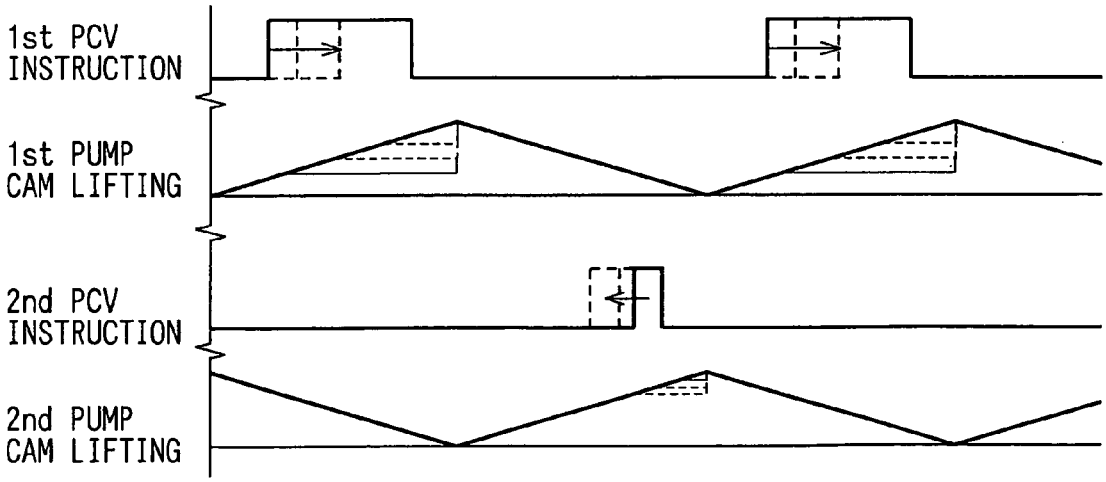
FIG. 6 is a timing chart of a transition control operation of the fuel supply device of FIG. 1.

When the cylinder reduction control is selected, a flag indicating that selection is set. In the case where the normal control has been selected while the aforementioned flag has been set, i.e., in the case where the cylinder reduction control is switched to the normal control, the following transition control is carried out immediately after the return to the normal control. FIG. 6 shows this transition control. The solid line shows a control immediately after switching to the normal control and the broken line shows a control in which a certain time has passed after the switching. Since the switching to the normal control is made, the second PCV 43*b* is energized, as shown in FIG. 6. However, immediately after the switching, a time at which the energization to the second PCV 43*b* starts is late and the feed quantity of the fuel is small, as shown in FIG. 6. Then, every time the fuel feed is performed, the period of the energization to the second PCV 43*b* becomes longer gradually, as shown with an arrow in FIG. 6, so that the feed quantity by the second pump 4*b* increases. In accordance with this, the period of the energization to the first PCV 43*a* becomes shorter so that the feed quantity by the first pump 4*a* is reduced. Finally, the basic state in which the fuel feed is shared by the first and second pumps 4*a* and 4*b* substantially evenly, as shown in FIG. 5A, is obtained. It should be noted that the flag is reset at a time of termination of the transition control.

As described above, by providing the transition control that changes a ratio of the feed quantity by the first pump 4*a* and that by the second pump 4*b* from the ratio in the cylinder reduction control in which the feed quantity by the second pump 4*b* is zero so as to gradually increase the ratio of the feed quantity by the second pump 4*b*, it is possible to prevent effects of rapid increase of the driving torque on the rotation of the engine, such as a shock on the engine.

Another transition control may be performed in the following manner, when the normal control is switched to the cylinder reduction control. In the other transition control, the feed quantity ratio of the first and second pumps 4*a* and 4*b* is set in such a manner the feed quantity by one of the pump (e.g., the first pump 4*a*) is larger than that by the other pump progressively, prior to stop the energization to one of the PCVs 43*a* and 43*b*. Then, after a predetermined transition period has passed, the PCV 43*b* of the other pump (e.g., the second pump 4*b*) for which the fuel feed is thinned out is placed in a state in which the energization is stopped.

One of the transition controls performed when the normal control is switched to the cylinder reduction control and that performed when the cylinder reduction control is switched to the normal control may be omitted. If only one transition control is performed, it is preferable to perform the transition control when the cylinder reduction control is switched to the normal control. This is because this switching occurs in a direction in which the load on the engine increases. Moreover, depending on the required specification, both the transition controls can simply be omitted.

In addition, the aforementioned description has been made on the assumption that closing of the second PCV 43*b* is stopped in the cylinder reduction control. However, in order to prevent the stop of closing of the only one of the PCVs 43*a* and 43*b* from occurring more frequently, it is preferable to stop closing of the first and second PCVs 43*a* and 43*b* alternately.

What is claimed is:

1. A fuel supply device of an internal combustion engine comprising:

a fuel pump including a plurality of pressure chambers each having a volume that is expanded and contracted by a power of the engine;

a plurality of opening/closing valves corresponding to the plurality of pressure chambers for opening and closing the pressure chambers, including at least a first opening/closing valve and a second opening/closing valve for opening and closing a first pressure chamber and a second pressure chamber, respectively, wherein an expansion time and a contraction time of the first the first pressure chamber is different from that of at least the second pressure chamber, the fuel pump being operable to sealingly store fuel in the pressure chambers by closing the opening/closing valves and supply the fuel in the pressure chambers by contracting of the volumes of the pressure chambers; and a controller for setting closing times of the opening/closing valves in accordance with a required quantity of fuel to be force fed, wherein the controller freely switches between a normal control in which all of the plurality of pressure chambers sequentially force feed fuel and a thinned-out control in which the force fed fuel is thinned out by stopping the closing of the first opening/closing valve to place the fuel in the first pressure chamber in a non-pressurized state, while continuing the opening and closing of the second opening/closing valve so that the second pressure chamber force feeds fuel.

2. A fuel supply device of an internal combustion engine comprising:

a fuel pump including a plurality of pressure chambers each having a volume that is expanded and contracted by a power of the engine;

a plurality of opening/closing valves corresponding to the plurality of pressure chambers for opening and closing the pressure chambers, wherein an expansion time and a contraction time of a first pressure chamber is different from that of at least a second pressure chamber, the fuel pump being operable to sealingly store fuel in the pressure chambers by closing the opening/closing valves and supply the fuel in the pressure chambers by contracting of the volumes of the pressure chambers; and a controller for setting closing times of the opening/closing valves in accordance with a required quantity of fuel to be force fed, wherein the controller freely switches between a normal control in which all of the plurality of pressure chambers sequentially force feed fuel and a thinned-out control in which the force fed fuel is thinned out by stopping the closing of at least one of the opening/closing valves to place the fuel in the respective pressure chamber in a non-pressurized state, wherein the device is set to perform a first transition control in which the closing time of the opening/closing valve of the pressure chamber for which the force fed fuel has been thinned out is initially delayed to force feed a small quantity of fuel and is then gradually put ahead to increase the quantity of force fed fuel immediately after switching from the thinned-out control to the normal control.

3. A fuel supply device of an internal combustion engine comprising:

a fuel pump including a plurality of pressure chambers each having a volume that is expanded and contracted by a power of the engine;

a plurality of opening/closing valves corresponding to the plurality of pressure chambers for opening and closing the pressure chambers, wherein an expansion time and a contraction time of a first pressure chamber is different from that of at least a second pressure chamber, the fuel pump being operable to sealingly store fuel in the pressure chambers by closing the opening/closing valves and supply the fuel in the pressure chambers by contracting of the volumes of the pressure chambers; and a controller for setting closing times of the opening/closing valves in accordance with a required quantity of fuel to be force fed, wherein the controller freely switches between a normal control in which all of the plurality of pressure chambers sequentially force feed fuel and a thinned-out control in which the force fed fuel is thinned out by stopping the closing of at least one of the opening/closing valves to place the fuel in the respective pressure chamber in a non-pressurized state, wherein the device is set to perform a second transition control in which the closing time of the opening/closing valve of the pressure chamber for which the force fed fuel is to be thinned out is gradually delayed to gradually reduce the amount of force fed fuel immediately before switching from the normal control to the thinned-out control.

4. The fuel supply device of claim 1, wherein the controller receives information relating to an operating state of the internal combustion engine, the controller predicts an amount of fuel required for subsequent operation of the internal combustion engine based on the received information, and the controller starts the thinned-out control when the predicted amount of fuel is small.

5. The fuel supply device of claim 1, wherein the normal control and the thinned-out control are switched in accordance with an operating state of the engine.

6. A fuel supply device of an internal combustion engine comprising:

a fuel pump including a plurality of pressure chambers each having a volume that is expanded and contracted by a power of the engine;

a plurality of opening/closing valves corresponding to the plurality of pressure chambers for opening and closing the pressure chambers, wherein an expansion time and a contraction time of a first pressure chamber is different from that of at least a second pressure chamber, the fuel pump being operable to sealingly store fuel in the pressure chambers by closing the opening/closing valves and supply the fuel in the pressure chambers by contracting of the volumes of the pressure chambers; and a controller for setting closing times of the opening/closing valves in accordance with a required quantity of fuel to be force fed, wherein the controller freely switches between a normal control in which all of the plurality of pressure chambers sequentially force feed fuel and a thinned-out control in which the force fed fuel is thinned out by stopping the closing of at least one of the opening/closing valves to place the fuel in the respective pressure chamber in a non-pressurized state, wherein the control is switched to the thinned-out control when the injection quantity of the engine is equal to or smaller than an injection quantity reference value and the injection-quantity change amount is equal to or smaller than an injection-quantity change amount reference value.

7. The fuel supply device of claim 1, wherein the pressure chamber stopped during the thinned-out control are sequentially changed out of all the pressure chambers.

8. The fuel supply device of claim 2, wherein the controller receives information relating to an operating state of the internal combustion engine, the controller predicts an amount of fuel required for subsequent operation of the internal combustion engine based on the received information, and the controller starts the thinned-out control when the predicted amount of fuel is small.

9. The fuel supply device of claim 2, wherein the normal control and the thinned-out control are switched in accordance with an operating state of the engine.

10. The fuel supply device of claim 2, wherein the control is switched to the thinned-out control when at least one of (1) the injection quantity of the engine is equal to or smaller than an injection quantity reference value and (2) the injection-quantity change amount is equal to or smaller than an injection-quantity change amount reference value.

11. The fuel supply device of claim 2, wherein the at least one pressure chamber stopped during the thinned-out control are sequentially changed out of all the pressure chambers.

12. The fuel supply device of claim 3, wherein the controller receives information relating to an operating state of the internal combustion engine, the controller predicts an amount of fuel required for subsequent operation of the internal combustion engine based on the received information, and the controller starts the thinned-out control when the predicted amount of fuel is small.

13. The fuel supply device of claim 3, wherein the normal control and the thinned-out control are switched in accordance with an operating state of the engine.

14. The fuel supply device of claim 3, wherein the control is switched to the thinned-out control when at least one of (1) the injection quantity of the engine is equal to or smaller than an injection quantity reference value and (2) the injection-quantity change amount is equal to or smaller than an injection-quantity change amount reference value.

15. The fuel supply device of claim 3, wherein the at least one pressure chamber stopped during the thinned-out control are sequentially changed out of all the pressure chambers.

* * * * *